US009281593B2

(12) United States Patent
Honda

(10) Patent No.: US 9,281,593 B2
(45) Date of Patent: Mar. 8, 2016

(54) CONNECTOR WHICH IS REDUCED IN POSSIBILITY OF DAMAGE DUE TO WARPING OF A CONNECTION OBJECT WITHOUT DECREASING THE INSERTABILITY OF THE CONNECTION OBJECT

(71) Applicant: Japan Aviation Electronics Industry, Limited, Tokyo (JP)

(72) Inventor: Yosuke Honda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/455,044

(22) Filed: Aug. 8, 2014

(65) Prior Publication Data

US 2015/0111415 A1 Apr. 23, 2015

(30) Foreign Application Priority Data

Oct. 22, 2013 (JP) ..... 2013-219416

(51) Int. Cl.
*H01R 12/79* (2011.01)
*H01R 12/88* (2011.01)

(52) U.S. Cl.
CPC ..... *H01R 12/88* (2013.01)

(58) Field of Classification Search
CPC ..... H01R 12/79; H01R 23/684; H01R 23/668
See application file for complete search history.

(56) References Cited

U.S. PATENT DOCUMENTS 6,089,905 A * 7/2000 Shimmyo et al. ..... 439/495
6,431,897 B1 8/2002 Hashiguchi et al.
8,636,531 B2 1/2014 Sasaki et al.
8,851,914 B2 * 10/2014 Lin et al. ..... 439/260
2005/0009383 A1 1/2005 Okura et al.
2007/0054529 A1 * 3/2007 Harlan et al. ..... 439/260
2007/0105423 A1 5/2007 Gillespie et al.
2008/0171460 A1 * 7/2008 Liu et al. ..... 439/260

(Continued)

FOREIGN PATENT DOCUMENTS

JP 6-77186 U 10/1994
JP 2001-143827 A 5/2001

(Continued)

OTHER PUBLICATIONS

Japanese Office Action issued on Sep. 17, 2014 in JP 2013-219416 with English translation of relevant parts.

*Primary Examiner* — Gary Paumen
(74) *Attorney, Agent, or Firm* — Collard & Roe, P.C.

(57) ABSTRACT

A connector is for connection to a plate-like connection object. The connector includes contacts, a housing holding the contacts, and an operating member for connecting the connection object to the contacts. The operating member has a pair of rotating shaft portions spaced apart from each other in a right-left direction and is rotatably supported by the housing so as to be displaceable between an initial position and a connecting position. The housing has a receiving portion which is open upward. The receiving portion is adapted to receive, from obliquely front, insertion of the connection object and to receive the operating member when the operating member is in the connecting position. The housing further has protruding portions in the rear part of the receiving portion for preventing upward warping of the connection object. The protruding portions are located between the pair of rotating shaft portions.

7 Claims, 9 Drawing Sheets

(56) References Cited

U.S. PATENT DOCUMENTS

| | | | | |
|---|---|---|---|---|
| 2009/0137141 | A1 | 5/2009 | Hashimoto et al. | |
| 2010/0130045 | A1* | 5/2010 | Higuchi | 439/260 |
| 2010/0248520 | A1 | 9/2010 | Miyazaki et al. | |
| 2011/0151682 | A1 | 6/2011 | Kodaira | |
| 2013/0023138 | A1* | 1/2013 | Sasaki et al. | 439/260 |
| 2013/0309887 | A1* | 11/2013 | Honda | 439/260 |

FOREIGN PATENT DOCUMENTS

| | | | |
|---|---|---|---|
| JP | 2002-063959 | A | 2/2002 |
| JP | 2002-367699 | A | 12/2002 |
| JP | 3124505 | U | 8/2006 |
| JP | 2007-194017 | A | 8/2007 |
| JP | 2009-064743 | A | 3/2009 |
| JP | 2009-129861 | A | 6/2009 |
| JP | 2010-049999 | A | 3/2010 |
| JP | 2010-061927 | A | 3/2010 |
| JP | 2011-154834 | A | 8/2011 |
| JP | 2013-48086 | A | 3/2013 |
| TW | 201037915 | A | 10/2010 |

* cited by examiner

CONNECTOR WHICH IS REDUCED IN POSSIBILITY OF DAMAGE DUE TO WARPING OF A CONNECTION OBJECT WITHOUT DECREASING THE INSERTABILITY OF THE CONNECTION OBJECT

This application is based upon and claims the benefit of priority from Japanese Patent Application No. 2013-219416, filed on Oct. 22, 2013, the disclosure of which is incorporated herein in its entirety by reference.

TECHNICAL FIELD

This invention relates to a connector for connecting a plate-like connection object such as a flexible flat cable (hereinafter referred to as an "FFC") or a flexible printed circuit (hereinafter referred to as an "FPC").

BACKGROUND ART

There is known a connector which, in order to connect a plate-like connection object, has a rotatable operating member in a housing holding contacts. In this connector, the connection object is inserted at a predetermined position of the housing in the state where the operating member is in its initial open position. Thereafter, the operating member is rotated from its initial open position to its connecting position, thereby establishing connection between the connection object and the contacts. With this configuration, an insertion force of the connection object can be made small and further a force required for operating the operating member can also be made small.

Connectors of this type are classified into two types in terms of an operating direction of the operating member. One is the type in which the operating member is rotated to the side opposite to an insertion opening for the connection object (hereinafter referred to as a "rear-flip type"). The other is the type in which the operating member is rotated to the insertion opening side for the connection object (hereinafter referred to as a "front-flip type") as disclosed in JP-A-2001-143827 (hereinafter referred to as "Patent Document 1").

The connector of the rear-flip type has a drawback that since the insertion opening for the connection object is defined to be narrow by the housing, the insertability of the connection object is poor. On the other hand, the connector of the front-flip type is excellent in the insertability of the connection object because the insertion opening is largely open when the operating member is in its initial open position, but has a problem that this type of connector is generally weak against warping of the inserted connection object (i.e. movement of a part of the inserted connection object in its thickness direction).

Herein, referring to FIG. 1, the connector disclosed in Patent Document 1 will be briefly described.

A connector of FIG. 1 comprises contacts 1, a housing 2 holding the contacts 1, and an operating member 3. The operating member 3 integrally has shaft portions 4 rotatably engaging the housing 2. The housing 2 has guide grooves 5 and engaging grooves 6 which respectively follow the guide grooves 5. The contacts 1 and the engaging grooves 6 cooperate to rotatably support the operating member 3.

A plate-like connection object (not illustrated) is inserted from an insertion opening 7 of the housing 2. In this event, end portions of the connection object are inserted into the guide grooves 5. When the operating member 3 is rotated to the insertion opening 7 side after the connection object is inserted at a predetermined position, the connection object is pressed against the contacts 1.

Since the end portions of the connection object are inserted into the guide grooves 5, projections 8 each defining the width of the guide groove 5 serve to prevent warping of the connection object.

SUMMARY OF THE INVENTION

However, in the connector of FIG. 1, since the projections 8 are provided near the insertion opening 7 of the housing 2, the projections 8 may hinder the insertion of the connection object to make poor the insertability of the connection object and, further, since it is difficult to enhance the strength of the projections 8, there is a possibility of damage due to warping of the connection object.

It is therefore an exemplary object of this invention to provide a connector which is reduced in possibility of damage due to warping of a connection object without decreasing the insertability of the connection object.

Other objects of this invention will become clear as the description proceeds.

According to an exemplary aspect of the present invention, there is provided a connector for connection to a plate-like connection object, comprising contacts, a housing holding the contacts, and an operating member for connecting the connection object to the contacts, wherein the operating member has a pair of rotating shaft portions spaced apart from each other in a right-left direction and is rotatably supported by the housing so as to be displaceable between an initial position and a connecting position, wherein the housing has a receiving portion which is open upward, wherein the receiving portion is adapted to receive, from its front, insertion of the connection object and to receive the operating member when the operating member is in the connecting position, wherein the housing has at least one protruding portion in a rear part of the receiving portion, and wherein the protruding portion is located between the pair of rotating shaft portions.

DESCRIPTION OF THE EMBODIMENT

Figure 1:
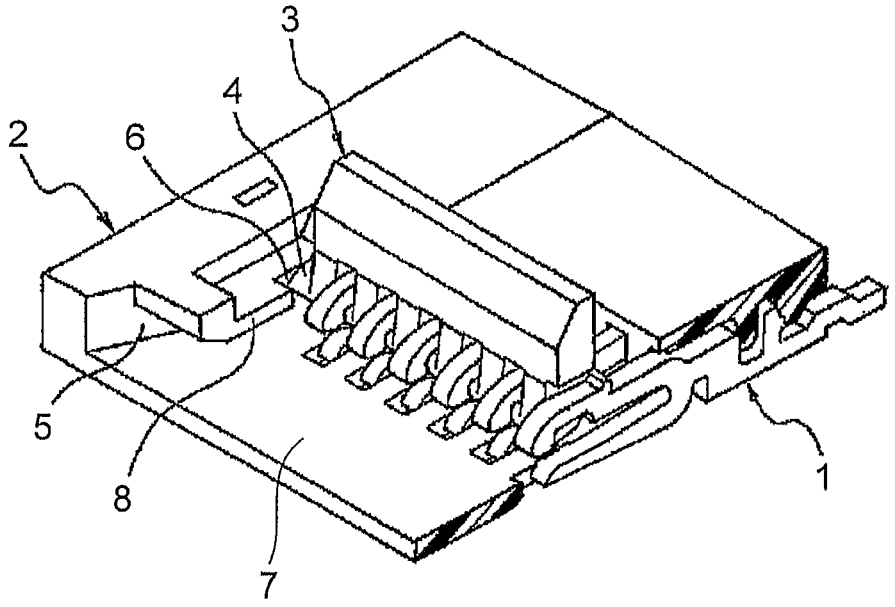
FIG. 1 is a perspective view showing a part of a connector disclosed in Patent Document 1 (JP-A-2001-143827)

Referring to the drawings, a connector according to an embodiment of this invention will be described. For the sake of description, a right-left direction (first direction) of the connector is given by A1, a front-rear direction (second direction) of the connector is given by A2, and an up-down direction (third direction) of the connector is given by A3.

Figure 2A:
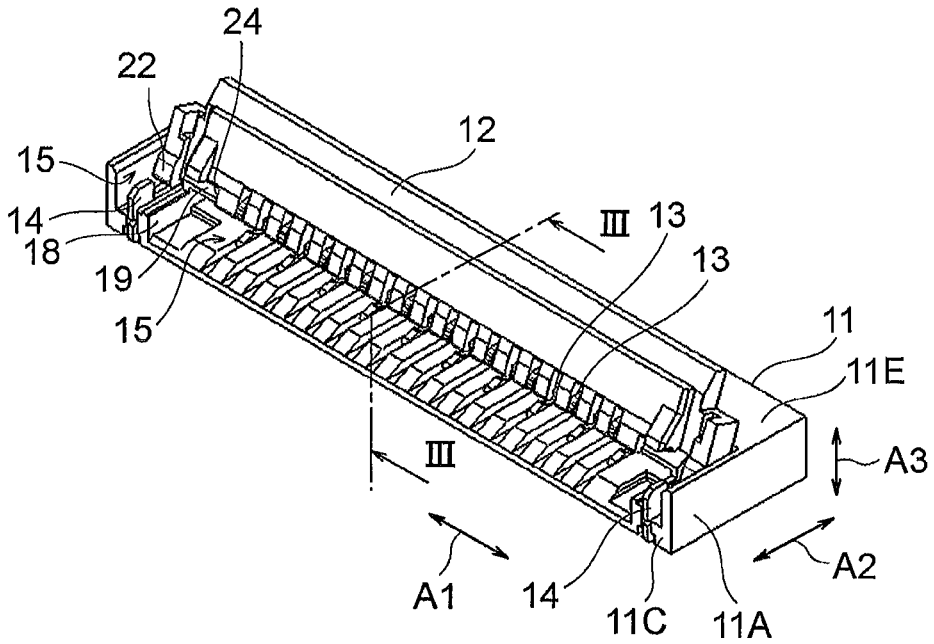
FIG. 2A is a perspective view as seen from one side of a connector according to an embodiment of this invention.
Figure 2B:
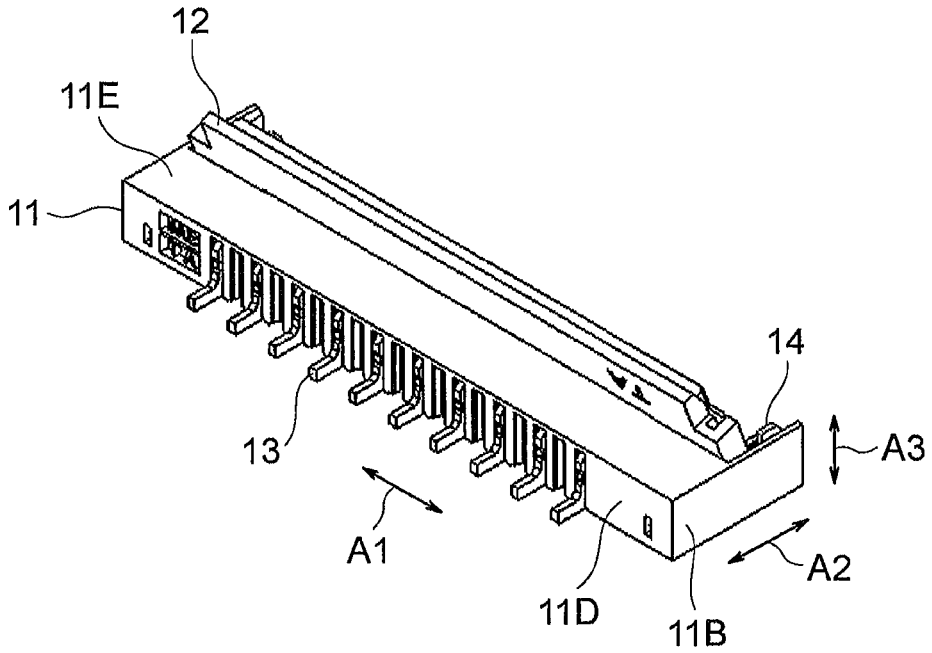
FIG. 2B is a perspective view as seen from the opposite side of the connector of FIG. 2A.
Figure 3:
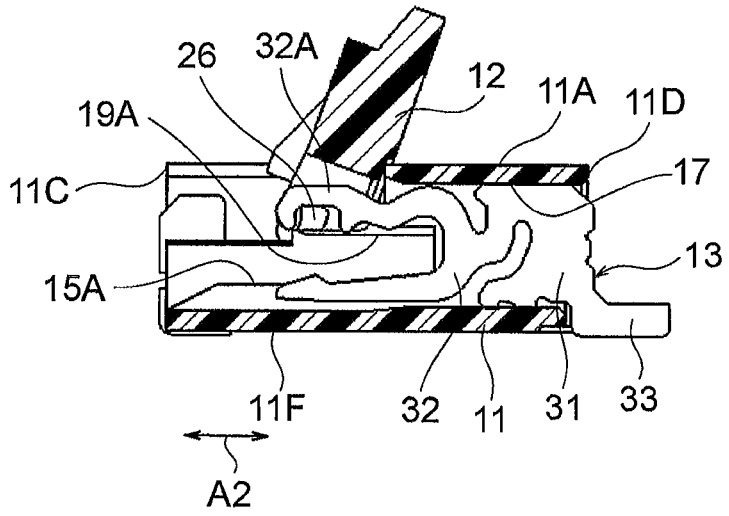
FIG. 3 is a cross-sectional view taken along line III-Ill of FIG. 2A.

Referring to FIGS. 2A, 2B, and 3, this connector is for connecting a plate-like connection object such as an FFC or FPC and comprises a housing 11 made of an insulating material, an operating member 12 made of an insulating material, a plurality of contacts 13 made of a conductive material, and two holddowns 14 made of a conductive material and press-fitted into right and left end portions of the housing 11. The housing 11 has a right side wall 11A, a left side wall 11B, a rear wall 11D, an upper wall 11E, and a lower wall 11F.

Figure 4:
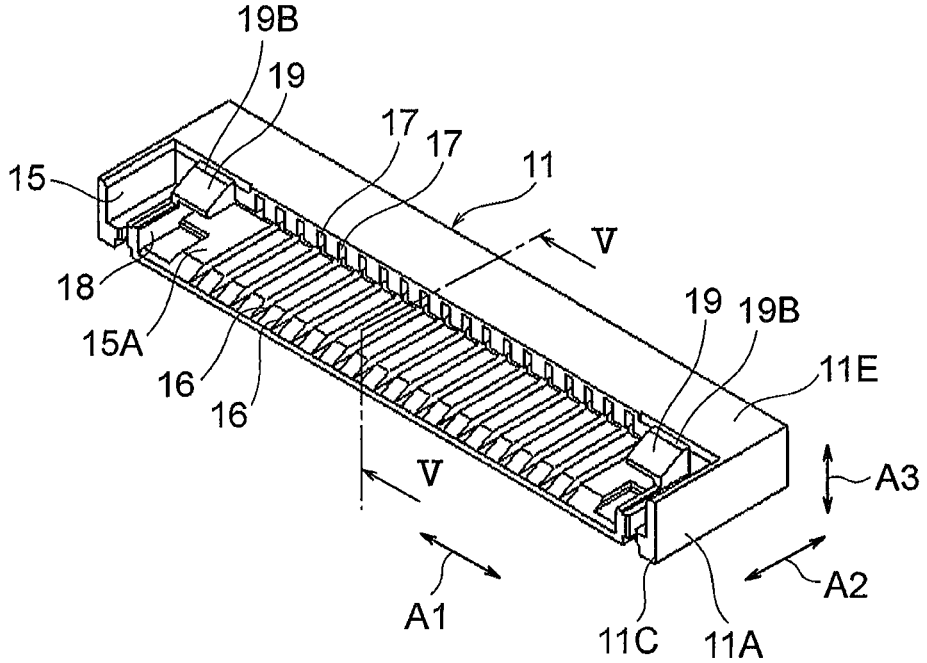
FIG. 4 is a perspective view showing a housing of the connector of FIG. 2A.

Referring also to FIG. 4, a receiving portion 15 is formed in the relatively front part of the housing 11 and opens to the outside in a direction toward a front surface 11C of the housing 11 and in a direction toward an upper surface of the upper wall 11E in order to receive the operating member 12 therein. On a bottom wall 15A (lower wall 11F) of the receiving portion 15, a plurality of grooves 16 are formed side by side in the right-left direction A1. In the rear of the receiving portion 15, contact holding holes 17 are formed side by side in the right-left direction A1 so as to correspond to the grooves 16. The contact holding holes 17 are open to the outside through the rear wall 11D.

An insertion guide 18 and a protruding portion 19 are formed near each of right and left ends of the receiving portion 15 of the housing 11. The connection object is inserted from the front along the bottom wall 15A of the receiving portion 15. Since the receiving portion 15 is open to the outside in the directions toward the front surface 11C and the upper surface of the upper wall 11E, the connection object can be easily aligned with the receiving portion 15 and can be inserted from obliquely above so that the insertion operation of the connection object is facilitated. Each insertion guide 18 is in the form of a wall extending in the front-rear direction A2 and in the up-down direction A3. The insertion of the connection object is guided by the right and left insertion guides 18. Therefore, the distance between the right and left insertion guides 18 is preferably designed to be equal to or slightly greater than the width of the connection object. Since a pair of rotating shaft portions 22 of the operating member 12 are configured to be disposed on the outer sides of the insertion guides 18 in the right-left direction A1, the width and so on of the rotating shaft portions 22 can be set large and thus the strength of the rotating shaft portions 22 can be made large so that the strength of the operating member 12 can also be made large. The insertion of the connection object is stopped when the connection object abuts against an abutting surface 21 (see FIG. 5A).

Figure 5A:
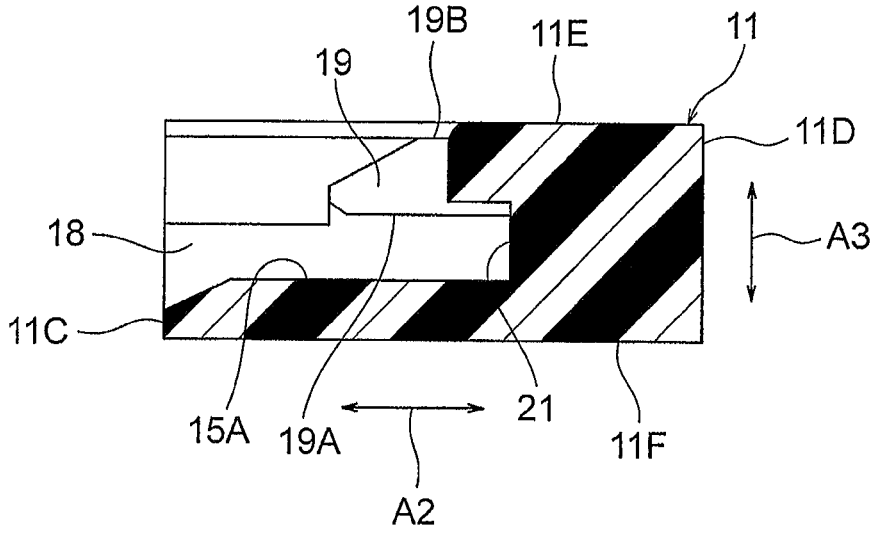
FIG. 5A is a cross-sectional view taken along line V-V of FIG. 4.
Figure 5B:
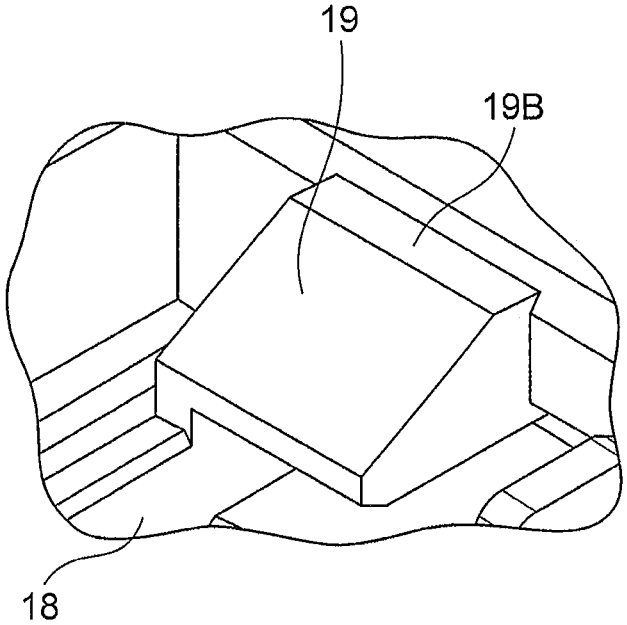
FIG. 5B is an enlarged view of a main part of FIG. 4.

Referring also to FIGS. 5A and 5B, each protruding portion 19 is formed so as to extend rearward from the vicinity of the middle, in the front-rear direction A2, of the receiving portion 15 of the housing 11 until it reaches the abutting surface 21. Further, each protruding portion 19 is joined to the vicinity of the insertion guide 18 and the vicinity of the abutting surface 21 and is thereby integrally formed with the housing 11. Specifically, each protruding portion 19 is joined to both the bottom wall 15A of the housing 11 through the insertion guide 18 joined to the bottom wall 15A and the upper wall 11E at its front end face of the housing 11. Therefore, the protruding portions 19 can be made strong. Each protruding portion 19 has an upper surface formed with a planar portion 19B substantially parallel to the upper surface (upper wall 11E) of the housing 11.

Both side portions of the connection object inserted along the bottom wall 15A of the receiving portion 15 respectively enter under the protruding portions 19. As a result, upward warping of the inserted connection object is prevented by the protruding portions 19. The distance between the bottom wall 15A of the receiving portion 15 and a lower surface 19A of each protruding portion 19 is preferably designed to be slightly greater than the thickness of the connection object.

Figure 6A:
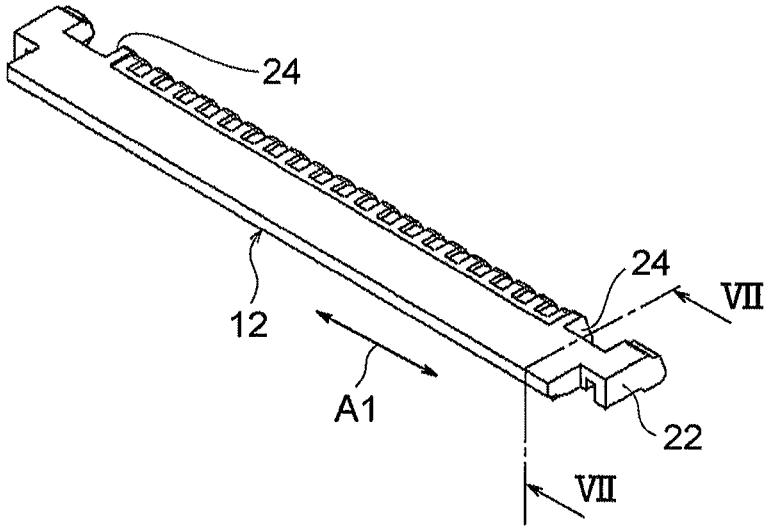
FIG. 6A is a perspective view as seen from one side of an operating member of the connector of FIG. 2A.
Figure 6B:
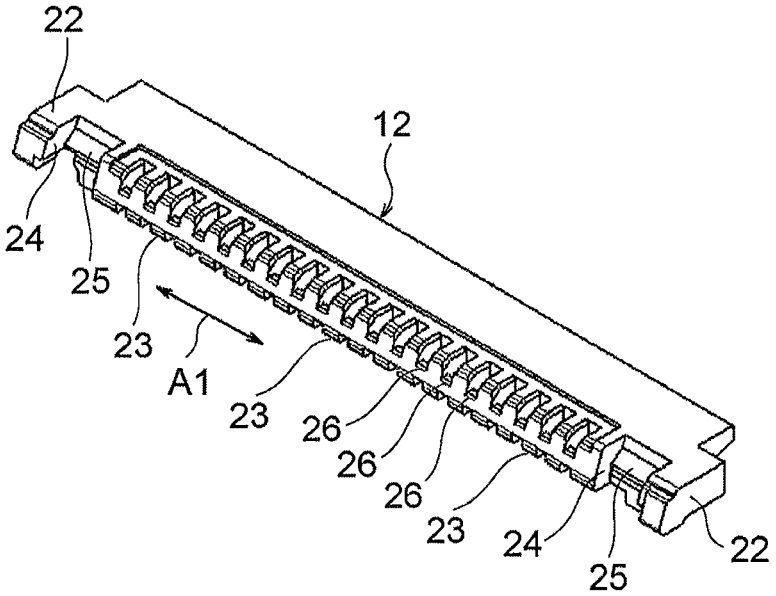
FIG. 6B is a perspective view as seen from the opposite side of the operating member of FIG. 6A.
Figure 7:
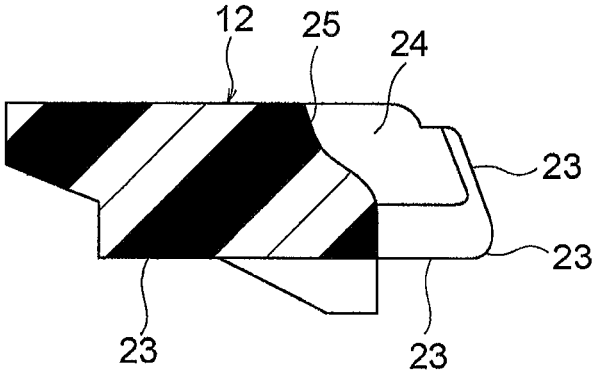
FIG. 7 is a cross-sectional view taken along line VII-VII of FIG. 6A.

Referring also to FIGS. 6A, 6B, and 7, the operating member 12 has the pair of rotating shaft portions 22 at its both ends in the right-left direction A1, respectively. The rotating shaft portions 22 are spaced apart from each other along an axis extending in the right-left direction A1.

The operating member 12 further has a pair of cutout portions 24 respectively formed adjacent to the rotating shaft portions 22 on the inner sides thereof so as to correspond to the protruding portions 19, a pair of planar portions 25 each formed in the cutout portion 24 so as to correspond to the planar portion 19B of the protruding portion 19, and a plurality of pressing portions 23 for pressing the connection object. Between the cutout portions 24, a plurality of support portions 26 respectively engaging the contacts 13 are formed adjacent to the pressing portions 23 as will be described hereinbelow.

Referring back to FIGS. 2A, 2B, and 3, the contacts 13 are held side by side by the housing 11 such that the contacts 13 are spaced apart from each other in the right-left direction A1 and electrically insulated from each other. The contacts 13 include two kinds of terminals with different shapes which are alternately arranged in the right-left direction A1. Each contact 13 has a fixed portion 31 press-fitted into the contact holding hole 17 of the housing 11, a movable portion 32 extending from the fixed portion 31 to the inside of the housing 11, and a terminal portion 33 extending from the fixed portion 31 to the outside of the housing 11. The movable portion 32 is elastically movable in the housing 11. The operating member 12 is rotatable relative to the housing 11 by engagement of the support portion 26 with a portion 32A of the movable portion 32 of each contact 13 and by engagement of the pair of rotating shaft portions 22 with the housing 11. That is, the housing 11 and the contacts 13 cooperate to rotatably support the operating member 12. The rotatable angle of the operating member 12 is limited by the housing 11.

In the state shown in FIGS. 2A, 2B, and 3, the protruding portions 19 are respectively located in the cutout portions 24 of the operating member 12. That is, the operating member 12 escapes the protruding portions 19 by means of the cutout portions 24. In this manner, since the protruding portions 19 are provided on the deep side, i.e. in the rear part, of the receiving portion 15 on the inner sides of the rotating shaft portions 22 of the operating member 12, the insertability of the connection object is improved and further the strength of the protruding portions 19 can be enhanced.

Figure 8:
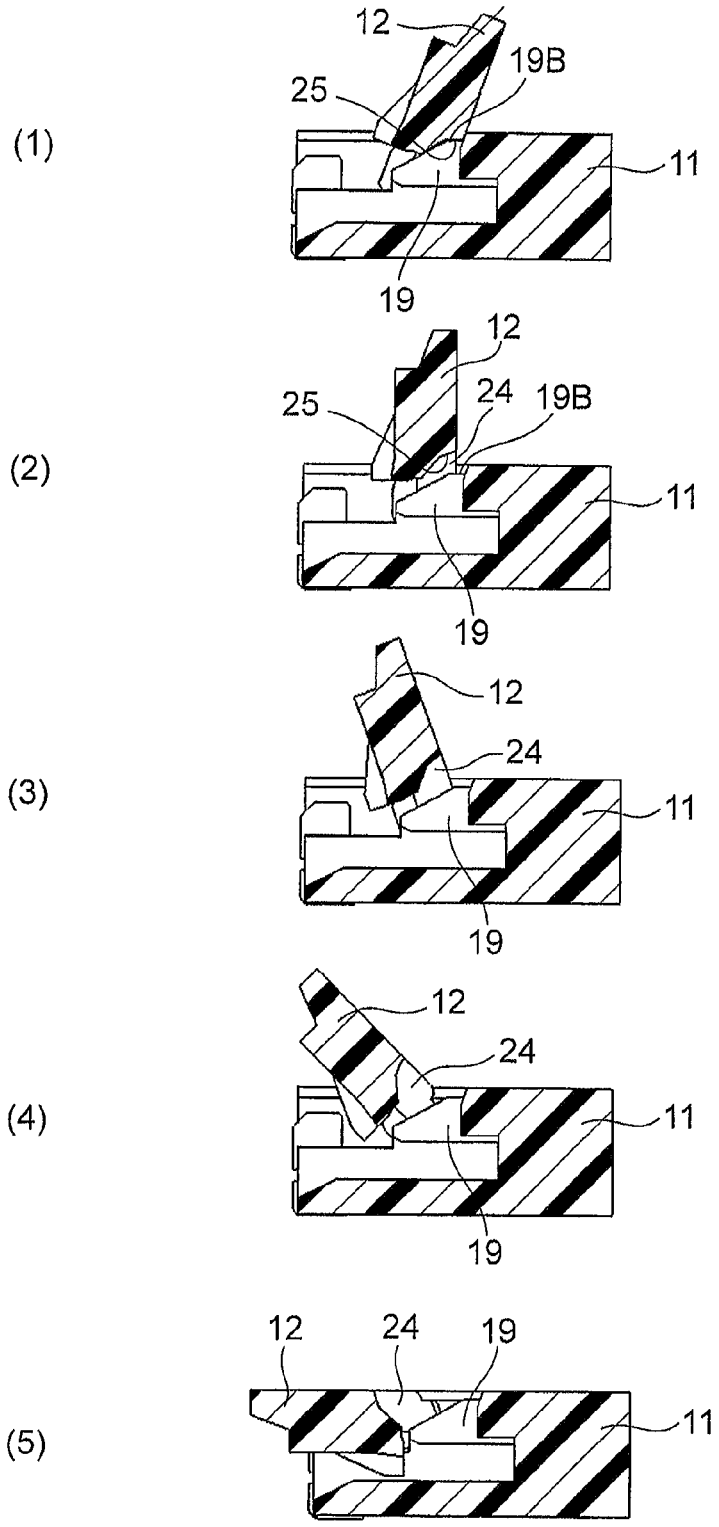
FIG. 8 shows the process of displacement of the operating member of the connector of FIG. 2A from its initial position to its connecting position, wherein (1) to (5) are cross-sectional views.

Referring next to FIG. 8, a description will be given of the process of displacement of the operating member 12 of the connector from its open state, i.e. its initial position (1), to its closed state, i.e. its connecting position (5).

First, when the operating member 12 is in the initial position (1), the planar portions 25 of the operating member 12 face the planar portions 19B of the protruding portions 19 in the up-down direction A3. Therefore, even if a downward load is applied to the operating member 12, this load is received by the planar portions 19B of the protruding portions 19 so that damage to the operating member 12 can be prevented.

By operation of tilting the operating member 12 to the front, the operating member 12 is displaced to the connecting position (5) through intermediate positions (2) to (4). The shape and size of the cutout portions 24 are designed so that the displacement of the operating member 12 is not hindered by the protruding portions 19 in any of the intermediate positions (2) to (4) and the connecting position (5). The operating member 12 is received in the receiving portion 15 when it is in the connecting position (5).

Figure 9A:
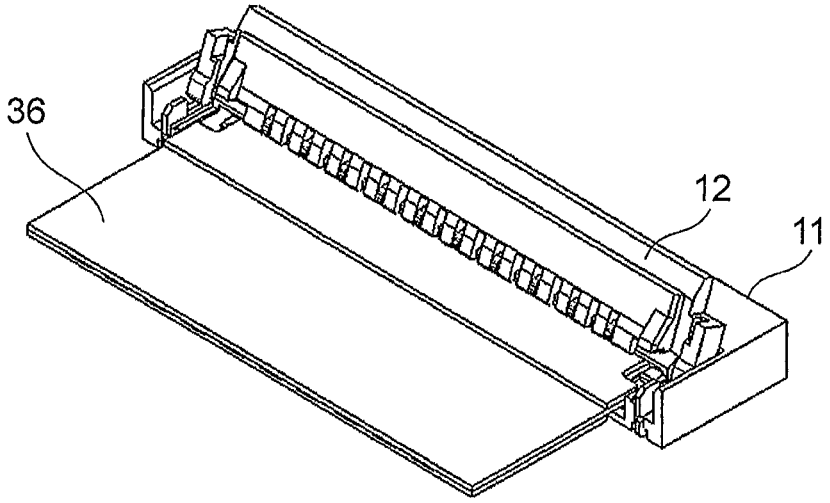
FIG. 9A is a perspective view showing a state where an FPC is inserted into the connector of FIG. 2A.
Figure 9B:
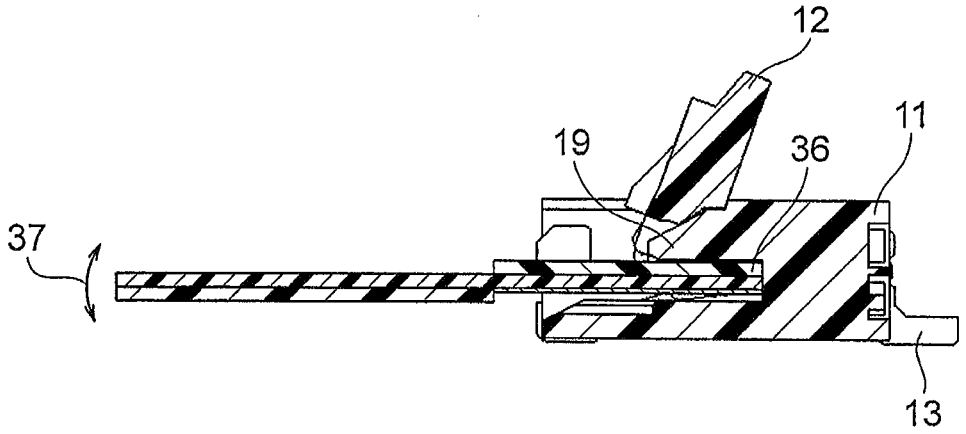
FIG. 9B is a cross-sectional side view of FIG. 9A.

Referring to FIGS. 9A and 9B, an FPC 36 as a connection object is inserted into the above-mentioned connector. In this event, the operating member 12 is in its initial position. If the FPC 36 is warped (if a force is applied to the FPC 36 in a direction of arrow 37 in FIG. 9B) in this state, the protruding portions 19 interfere with the FPC 36. Since the protruding portions 19 are formed on the deep side of the insertion opening for the FPC 36, the load due to the warping force 37 applied to the FPC 36 is reduced so that damage to the protruding portions 19 can be prevented. It is possible to prevent excessive displacement of the operating member 12 due to the warping force 37 applied to the FPC 36 and thus to reduce a load which is caused by the warping force 37 transmitted to the contacts 13 through the operating member 12 or a load which is caused by the warping force 37 directly transmitted to the contacts 13, thereby preventing damage or deformation of the contacts 13.

Figure 10A:
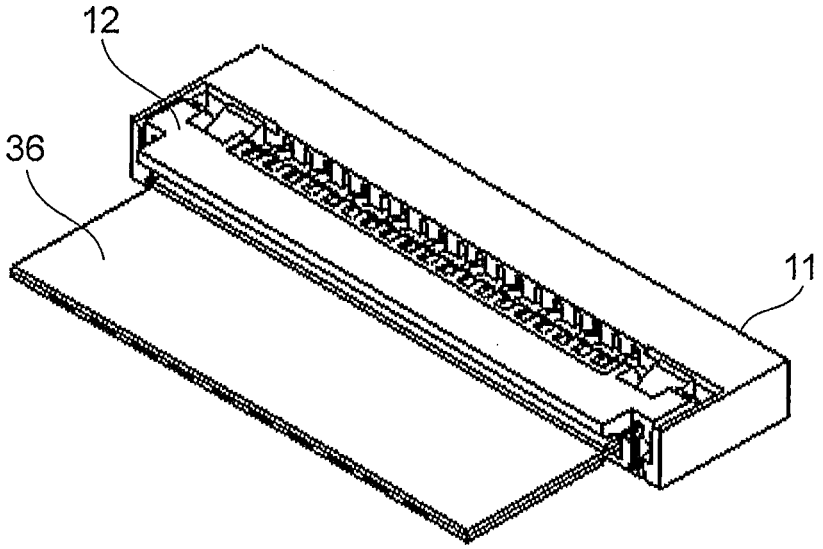
FIG. 10A is a perspective view showing a state where the FPC is connected to the connector of FIG. 2A.
Figure 10B:
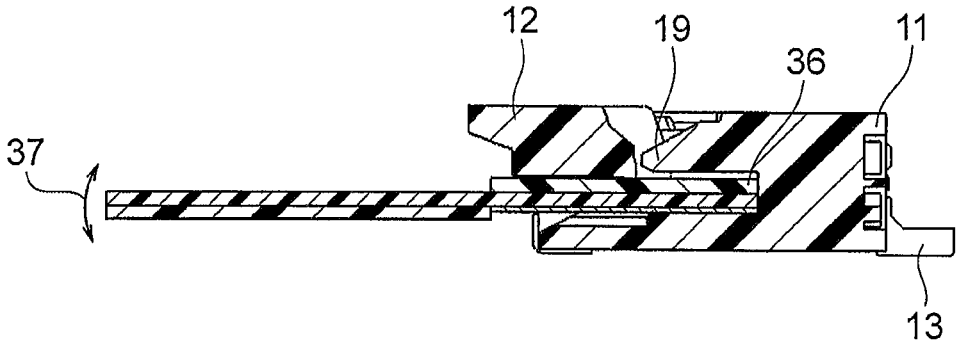
FIG. 10B is a cross-sectional side view of FIG. 10A.

Referring to FIGS. 10A and 10B, the FPC 36 is inserted into the connector and further the operating member 12 is displaced to its connecting position. That is, this is the state where the FPC 36 is connected to the connector. If the FPC 36 is warped in this state, while the operating member 12 is slightly displaced, the protruding portions 19 interfere with the FPC 36 in the same manner as in the case where the operating member 12 is in its initial position. Accordingly, also in this state, it is possible to prevent damage to the protruding portions 19 and to prevent damage or deformation of the contacts 13. Further, it is also possible to prevent the operating member 12 from returning in a direction toward its initial position.

While the description has been given of the case where the FPC 36 is connected to the connector, an FFC can alternatively be used as a connection object in the same manner as described above.

In the above-mentioned embodiment, the protruding portions 19 are provided at two positions at both end portions of the receiving portion 15, i.e. for the pair of insertion guides 18, respectively. However, it is needless to say that various modifications can be made, such as providing a protruding portion 19 for only one of the pair of insertion guides 18, i.e. providing only one protruding portion 19 in total, or further providing one or more protruding portions 19 between the pair of protruding portions 19.

The connector described above is suitable for use in a mobile device such as a notebook personal computer, but can also be used for various other devices.

This invention is not limited to the above-mentioned embodiment and part or the whole thereof can also be described as the following supplementary notes but is not limited thereto.

(Supplementary note 1) A connector for connection to a plate-like connection object, comprising:

Contacts 13;

a housing 11 holding the contacts; and an operating member 12 for connecting the connection object to the contacts, wherein the operating member has a pair of rotating shaft portions 22 spaced apart from each other in a right-left direction A1 and is rotatably supported by the housing so as to be displaceable between an initial position (1) and a connecting position (5), wherein the housing has a receiving portion 15 which is open upward, wherein the receiving portion is adapted to receive, from its front, insertion of the connection object and to receive the operating member when the operating member is in the connecting position, wherein the housing has at least one protruding portion 19 in a rear part of the receiving portion, and wherein the protruding portion is located between the pair of rotating shaft portions.

(Supplementary note 2) The connector according to supplementary note 1, wherein the receiving portion has a pair of insertion guides 18 for guiding the insertion of the connection object, the pair of insertion guides is located between the pair of rotating shaft portions, and the protruding portion is located between the pair of insertion guides.

(Supplementary note 3) The connector according to supplementary note 1 or 2, wherein the protruding portion is joined to both an upper wall 11E and a bottom wall 11F of the housing.

(Supplementary note 4) The connector according to any one of supplementary notes 1-3, wherein the operating member is tilted to the front relative to the housing from the initial position to reach the connecting position.

(Supplementary note 5) The connector according to any one of supplementary notes 1-4, wherein the operating member has, at a position corresponding to the protruding portion in the right-left direction, a cutout portion 24 for escaping the protruding portion.

(Supplementary note 6) The connector according to any one of supplementary notes 1-5, wherein the protruding portion has a planar portion 19B at its upper surface and the operating member has a planar portion 25 which faces the planar portion of the protruding portion when the operating member is in the initial position.

(Supplementary note 7) The connector according to any one of supplementary notes 1-6, wherein the contacts include two kinds of terminals with different shapes which are arranged side by side in the right-left direction.

(Supplementary note 8) The connector according to any one of supplementary notes 1-7, wherein the protruding portion is disposed adjacent to each of the pair of rotating shaft portions in the right-left direction.

What is claimed is:

1. A connector for connection to a plate-like connection object, comprising:

contacts;

a housing holding the contacts; and an operating member for connecting the connection object to the contacts, wherein the operating member has a pair of rotating shaft portions spaced apart from each other in a right-left direction and is rotatably supported by the housing so as to be displaceable between an initial position and a connecting position, wherein the housing has an upper wall and a receiving portion which is open upward in front of the upper wall, wherein the receiving portion is adapted to receive, from its front, insertion of the connection object and to receive the operating member when the operating member is in the connecting position, wherein the receiving portion has a particular wall defining a pair of insertion guides which is located between the rotating shaft portions for guiding the insertion of the connection object, wherein the housing further has at least one protruding portion in a rear part of the receiving portion, and wherein the protruding portion is located between the insertion guides and joined to both of the upper wall and the particular wall.

2. The connector according to claim 1, wherein the housing further has a lower wall under the receiving portion, the protruding portion is joined to the lower wall of the housing.

3. The connector according to claim 1, wherein the operating member is tilted to the front relative to the housing from the initial position to reach the connecting position.

4. The connector according to claim 1, wherein the operating member has, at a position corresponding to the protruding portion in the right-left direction, a cutout portion for escaping the protruding portion.

5. The connector according to claim 1, wherein the protruding portion has a planar portion at its upper surface and the operating member has a planar portion which faces the planar portion of the protruding portion when the operating member is in the initial position.

6. The connector according to claim 1, wherein the contacts include two kinds of terminals with different shapes which are arranged side by side in the right-left direction.

7. The connector according to claim 1, wherein the protruding portion is disposed adjacent to each of the pair of rotating shaft portions in the right-left direction.

* * * * *